US006583607B1

(12) United States Patent
Marty et al.

(10) Patent No.: US 6,583,607 B1
(45) Date of Patent: Jun. 24, 2003

(54) LINEAR REGULATOR WITH A SELECTABLE OUTPUT VOLTAGE

(75) Inventors: Nicolas Marty, Claix (FR); Marco Cioci, Grenoble (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/672,892

(22) Filed: Sep. 29, 2000

(30) Foreign Application Priority Data

Oct. 1, 1999 (FR) ..... 99 12524

(51) Int. Cl.[7] ..... G05F 1/40; G05F 1/44; G05F 1/56

(52) U.S. Cl. ..... 323/273; 323/279; 323/275

(58) Field of Search ..... 323/273, 274, 323/265

(56) References Cited

U.S. PATENT DOCUMENTS

| | | | | |
|---|---|---|---|---|
| 4,054,843 A | * | 10/1977 | Hamada | 330/263 |
| 4,186,436 A | | 1/1980 | Ishiwatari | 363/60 |
| 4,241,303 A | * | 12/1980 | Thompson | 323/303 |
| 4,752,699 A | | 6/1988 | Cranford, Jr. et al. | 307/297 |
| 5,010,292 A | * | 4/1991 | Lyle, Jr. | 323/274 |
| 5,124,631 A | | 6/1992 | Terashima | 323/313 |
| 5,177,431 A | * | 1/1993 | Smith et al. | 323/349 |
| 5,319,303 A | * | 6/1994 | Yamada | 323/313 |
| 5,341,086 A | * | 8/1994 | Fukudome | 323/273 |
| 5,963,439 A | | 10/1999 | Wuidart et al. | 363/46 |
| 6,020,727 A | | 2/2000 | Bernard et al. | 323/269 |

FOREIGN PATENT DOCUMENTS

| | | | |
|---|---|---|---|
| EP | 0 717 333 A | 6/1996 | G05F/1/563 |

OTHER PUBLICATIONS

French Search Report from French Patent Application 99 12524, filed Oct. 1, 1999.

* cited by examiner

*Primary Examiner*—Bao Q. Vu
(74) *Attorney, Agent, or Firm*—Wolf, Greenfield & Sacks; James H. Morris

(57) ABSTRACT

A control method and a linear regulator of the type including a power MOS transistor, controlled by a differential amplifier having a first input terminal receiving a reference voltage and a second input terminal receiving, via a switchable resistor circuit, the output voltage of the regulator, a smooth switching of the resistors being provided.

9 Claims, 2 Drawing Sheets

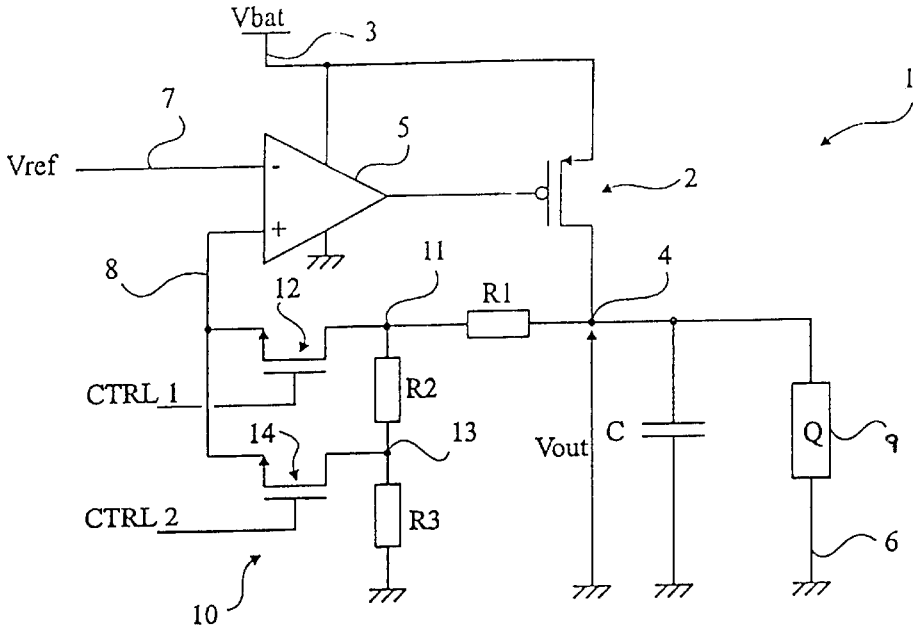
Fig 1
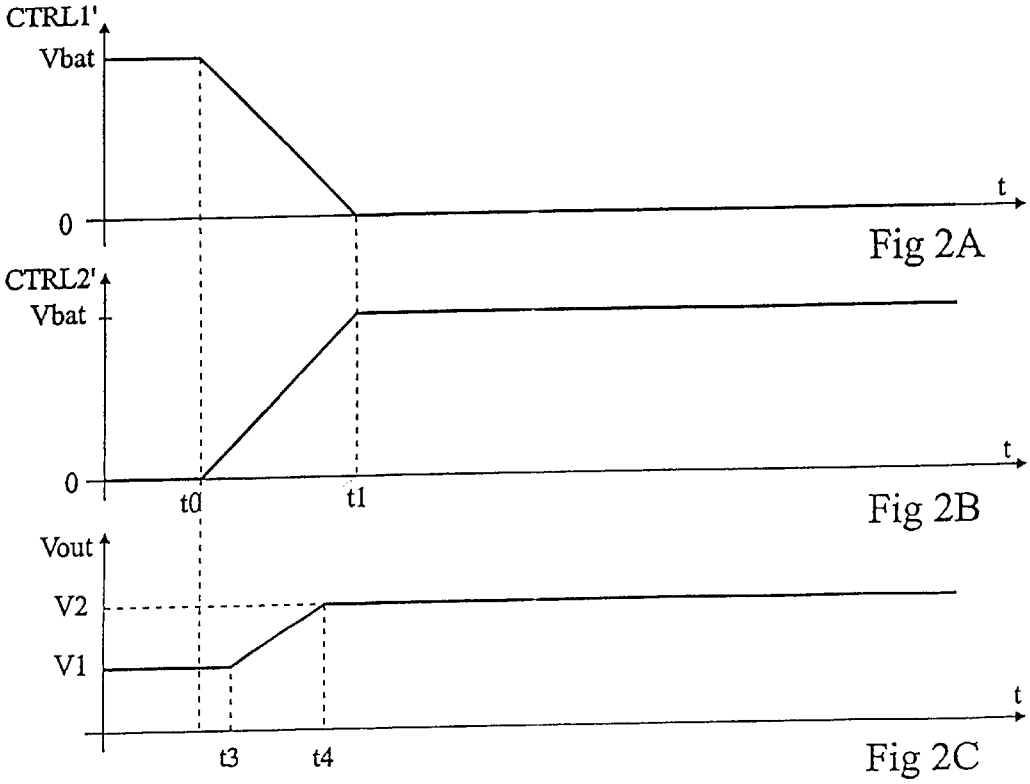

LINEAR REGULATOR WITH A SELECTABLE OUTPUT VOLTAGE

BACKGROUND OF THE INVENTION

1. Field of the Invention

The present invention relates to linear regulators of the type including a power MOS transistor intended to be connected, in series with a load to be supplied, between two D.C. terminals, the power MOS transistor being controlled by an amplifier-regulator for regulating the voltage across the load to a predetermined value. The present invention more specifically relates to linear regulators of the type having a low series voltage drop, that is, in which the voltage drop in the power transistor is minimized. Among these, the present invention more specifically relates to linear regulators of the type selecting the output voltage level, that is, including, in the regulator feedback loop, a circuit of switchable resistors for selecting one resistive path or another according to the desired output voltage.

2. Discussion of the Related Art

FIG. 1 shows an example of a conventional diagram of a linear regulator of the type to which the present invention applies.

Regulator 1 is essentially formed of a power MOS transistor 2, for example with a P channel, connected between a terminal 3 for application of a more positive supply voltage (Vbat) and an output terminal 4 of regulator 1. Terminal 4 is intended for being connected to a first terminal of a load (Q) 9, the other terminal of which is connected to a terminal 6 of application of a more negative supply voltage, for example the ground. A capacitor C is connected in parallel on load 2 to filter and stabilize output voltage Vout of regulator 1.

Power transistor 2 is controlled by a differential amplifier 5, an inverting input 7 of which receives a reference voltage Vref, generally provided by a voltage reference circuit of bandgap type or any other type of generator of a steady and precise voltage, and a noninverting input 8 of which receives, via a switchable resistor circuit 10, output voltage Vout.

In the field of application of the present invention, the regulator feedback loop applies a proportionality coefficient to voltage Vout, which depends on the desired output voltage level. It should thus be noted that the present invention applies to linear regulators in which output voltage Vout is greater than the reference voltage to enable lowering the voltage level of the non-inverting input of amplifier 5.

In linear regulators with several selectable output voltages, it is preferred to use a network of switchable resistors in the feedback loop rather than on the reference voltage application input. Indeed, this reference voltage is desired to be as precise as possible and is generally used by other regulators of the system and must thus keep a fixed value.

In the example shown in FIG. 1, regulator 1 can provide two distinct voltages according to the configuration in which circuit 10 is placed. Circuit 10 is formed, for example, of three resistors R1, R2, and R3 in series between terminal 4 and the ground. The junction point 11 of resistor R1 and resistor R2 is connected, via a first MOS transistor 12, for example with an N channel, to non-inverting input 8 of amplifier 5. The junction point 13 of resistor R2 and resistor R3 is connected, via a second MOS transistor 14, for example with an N channel, to non-inverting terminal 8. The respective gates of transistors 12 and 14 receive logic control signals CTRL1 and CTRL2 to select the resistive ratio of dividing bridge R1-R2-R3 according to the respective states of transistors 12 and 14. For example, for the regulator to provide a voltage Vout of the higher level, transistor 12 is off and transistor 14 is on, the respective control signals CTRL1 and CTRL2 of transistors 12 and 14 being low and high. To switch to a voltage Vout of lower level, transistor 14 is turned off and transistor 12 is turned on, by inverting the respective states of signals CTRL1 and CTRL2.

A problem that is raised in this type of regulator is that overvoltages on output Vout often appear upon changes of reference by switching of the transistors of circuit 10. Indeed, as one of transistors 12 and 14 is switched on and as the other one is switched off, amplifier 5 is abruptly unbalanced and will thus try to be balanced again by, for example, having voltage Vout rise from one level to another until non-inverting terminal 8 of amplifier 5 returns back to the voltage of balance with voltage Vref. However, part of the current that flows through the low resistors of bridge R1-R2-R3 is deviated to the input of amplifier 5 to charge the gate capacitor of the differential stage generally included by the amplifier. During this transient state, the ratio of the resistive bridge is thus not maintained. As a result, amplifier 5 only recovers a balance between its inputs with a delay associated, for example, with the magnitude of the input gate capacitance. This delay causes, when the switching occurs from the lower level to the upper level, an overvoltage on output Vout. The transient state progressively disappears by having voltage Vout decrease to reach the steady state.

It should be noted that delays may originate from other circuit stages, for example, other stages of amplifier 5. This depends on the regulator structure and what has been discussed for the input response time of amplifier 5 after a level change order of course also applies for any response time of the circuit downstream of input 8.

It should also be noted that the same problem may arise upon a switching from the upper level to the lower level, in the presence of a delay due, for example, to the discharge time of the gate capacitor of the input differential stage of amplifier 5. In this case, an undervoltage occurs upon switching.

Overvoltages due to output voltage switchings of linear regulators occur when this switching increases the output voltage level and possible undervoltages occur when the switching decreases the output voltage. Such undervoltages and/or overvoltages can be disturbing in some applications, especially when precise output levels are desired.

It should be noted that the magnitude of the undervoltage or overvoltage depends on the magnitude of the capacitance (s) involved in the path of the signals in the circuit. Now, the capacitance(s) may have large values for other reasons. For example, for the differential input stage of amplifier 5, the gate capacitance can be on the order of one picofarad to ensure a stability further required by amplifier 5.

An example of application in which this type of problem can be encountered is the field of portable phones where linear regulators are used to supply the different telephone circuits. In this type of application, the precision tolerances required for circuit output supply voltages are plus or minus 3%. This low tolerance is difficult to maintain with conventional linear regulators of the type described hereabove.

SUMMARY OF THE INVENTION

The present invention aims at providing a novel solution for switching the output of a linear regulator between two levels.

The present invention more specifically aims at providing a solution that limits undervoltages and/or overvoltages at the regulator output.

The present invention also aims at providing a solution that is compatible with the conventional electric circuit of a linear regulator.

To achieve these and other objects, the present invention provides a method for controlling a linear regulator of the type including a power MOS transistor, controlled by a differential amplifier having a first input terminal receiving a reference voltage and a second input terminal receiving, via a switchable resistor circuit, the output voltage of the regulator, a smooth switching of said resistors being provided.

According to an embodiment of the present invention, applied to a regulator in which the resistors of a dividing bridge are switched by means of at least two MOS control transistors, inverted voltage ramps, the direction of which is determined by the switching direction, are applied on the respective gates of these transistors.

According to an embodiment of the present invention, the duration of the ramps is chosen to maintain, on the second input of the differential amplifier, a voltage level substantially corresponding to the level of the reference voltage even during switching phases, to avoid unbalancing the differential amplifier.

The present invention also provides a linear regulator of the type including a power MOS transistor, controlled by a differential amplifier having an input terminal receiving, via a circuit of resistors switchable by means of MOS control transistors, a voltage proportional to the output voltage provided by the regulator, and including at least two circuits for generating inverted ramps for controlling the respective gates of said control transistors.

According to an embodiment of the present invention, each ramp generation circuit includes, in series between two supply terminals, two transistors of opposite channel types, the midpoint of their series connection providing, via a storage capacitor, said voltage ramp.

According to an embodiment of the present invention, the power MOS transistor is of a first channel type, the MOS control transistors being of a second channel type.

According to an embodiment of the present invention, the power MOS transistor and the MOS control transistors are of a same channel type.

The foregoing objects, features and advantages of the present invention will be discussed in detail in the following non-limiting description of specific embodiments in connection with the accompanying drawings.

BRIEF DESCRIPTION OF THE DRAWINGS

FIG. 1, previously described, is meant to show the state of the art and the problem to solve;

FIGS. 2A, 2B, and 2C illustrate, in the form of timing diagrams, an embodiment of the method for controlling a linear regulator according to the present invention;

DETAILED DESCRIPTION

Figure 3:
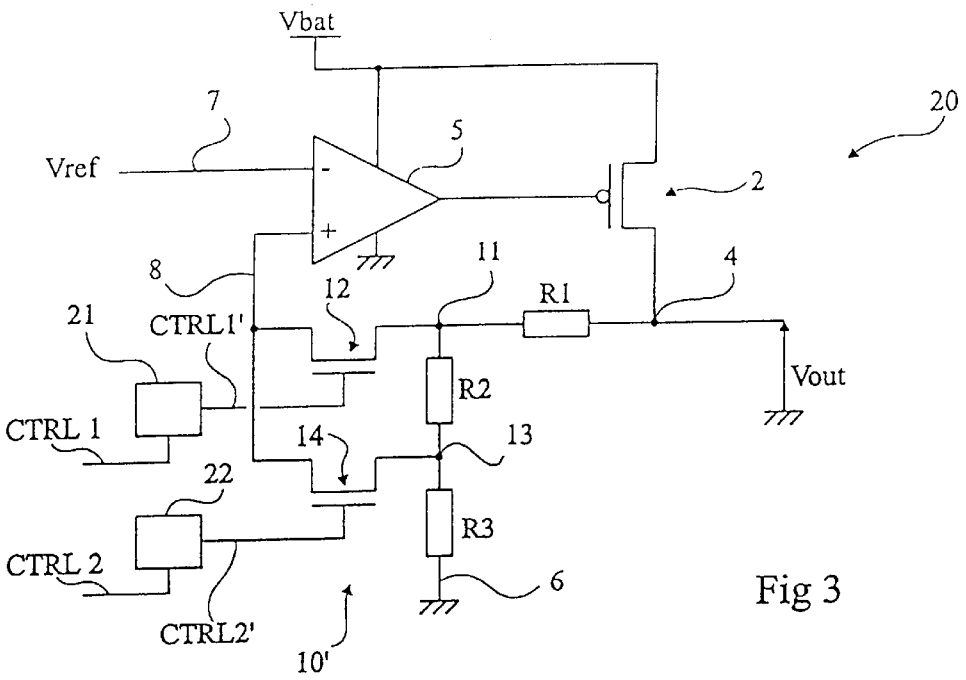
FIG. 3 schematically shows a linear regulator according to an embodiment of the present invention.

The same elements have been designated with the same references in the different drawings. For clarity, only those elements that are necessary to the understanding of the present invention have been shown in the drawings and will be described hereafter. In particular, the internal structure of the regulator amplifier has not been detailed and is perfectly conventional. It should only be noted that it includes a differential input stage and an output stage generally formed of a MOS transistor in series with a resistor.

A first solution to limit overvoltages would be to size the resistors of bridge R1-R2-R3 R3 so that the current charging the gate of the input differential stage of amplifier 5 is negligible as compared to the current flowing through the low resistors (R2, R3) of the bridge. A disadvantage of this solution is that resistors of low value would then have to be used, which would considerably increase the consumption of the linear regulator. Such a consumption increase is not desirable, especially for applications where the systems are battery-supplied.

A feature of the present invention is to provide a smooth switching of the transistors (12, 14, FIG. 1) constitutive of the voltage selector circuit. Thus, according to the present invention, the switches of the output voltage selector circuit are not controlled by logic signals having abrupt edges, but by ramps. When two switches are used, these ramps have opposite directions.

FIGS. 2A, 2B, and 2C illustrate, by timing diagrams showing an example of shape of control signals CTRL1' and CTRL2' of the switches (12, 14) and of signal Vout of a linear regulator such as illustrated in FIG. 1, an embodiment of a control method according to the present invention.

It is assumed that the regulator is desired to be controlled to an operation at the highest output voltage level (V2). Accordingly, initially, transistor 12 is on and transistor 14 is off. Referring to the example of N-channel transistors 12 and 14, signals CTRL1' and CTRL2' thus respectively are at high and low states. In FIGS. 2A to 2C, it has been assumed that a high logic state corresponds to a voltage Vbat and that a low logic state corresponds to the ground. At a time t0, the switching of circuit 10 is controlled to switch the output voltage levels from low level V1 to high level V2. Transistor 12 must thus be turned off and transistor 14 must be turned on. For this purpose, according to the present invention, signals CTRL1' and CTRL2' have the shape of respectively decreasing and increasing voltage ramps, between time t0 and a switching end time tI when signals CTRL1' and CTRL2' are respectively low and high.

Another feature of the present invention is that the voltage ramps are sized to ensure that both transistors 12 and 14 are on together with inverse resistivity variations, for a certain duration (t3–t4) compatible with the desired switching duration. For example, transistor 12 is controlled by ramp CTRL1', the decrease of which is provided so that the resistivity of transistor 12 approximately varies from 0 to infinity between times t3 and t4 (for example, approximately a few microseconds), and transistor 14 is controlled by a ramp CTRL2', the increase of which is provided so that the resistivity of transistor 14 approximately varies from infinity to 0 between times t3 and t4. This simultaneous conduction translates, on output level Vout, as a progressive variation from level V1 to level V2 between times t3 and t4. Since the voltage level at input 8 of amplifier 5 undergoes no more jump, there is no more charge (or discharge) delay of the gate capacitors of the input differential stage or of the other capacitors, which would previously adversely affect the system response.

It should be noted that the control signals are not necessarily symmetrical. It is important to never unbalance amplifier 5 and thus to maintain a voltage level on input 8 that is close to the level on input 7. As an example, a difference on the order of 20% may be accepted between the respective durations of the two voltage ramps.

It should be noted that the respective positions of times t3 and t4 between times t0 and t1 do not depend on the values of resistors R1, R2, and R3. Indeed, the respective source voltages of transistors 12 and 14 now remain substantially constant and equal to the voltage of terminal 8 of amplifier 5, and thus to voltage Vref.

It should also be noted that what has been discussed hereabove in relation with a switching from level V1 to level V2 also applies, by inverting the directions of the control ramps, to a switching from level V2 to level V1 , to avoid a possible output undervoltage.

FIG. 3 schematically shows an embodiment of a linear regulator 20 according to the present invention. Regulator 20 substantially includes the same components as regulator 1 described in relation with FIG. 1. The only difference is the addition, upstream of the respective gates of transistors 12 and 14 of switching circuit 10', of circuits 21 and 22 for generating ramps CTRL1' and CTRL2' based on conventional logic control signals CTRL1 and CTRL2.

It should be noted that, according to the present invention, the structures of circuits 21 and 22 are preferably identical. Only the control signals that they receive as inputs differ from each other so that the ramp provided as an output is inverted in circuit 21 with respect to that of circuit 22.

It should also be noted that the time constant determining the duration of the switching ramps must be chosen to be sufficiently fast to avoid delaying too much the level switching of output voltage Vout.

Figure 4:
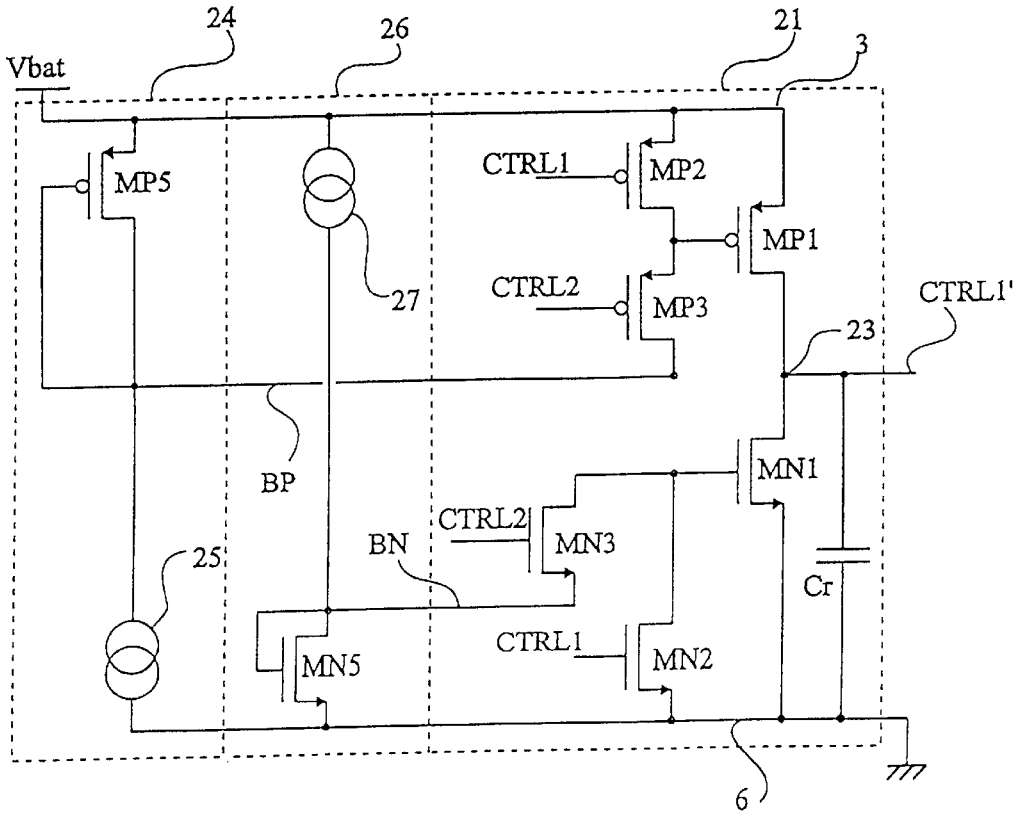
FIG. 4 is a detailed electric diagram of an embodiment of a circuit for controlling a voltage selector switch of a regulator according to the present invention.

FIG. 4 shows an embodiment of a circuit, for example, 21, for generating control ramps CTRL1'.

A circuit 21 for generating a ramp CTRL1' according to the present invention is based on the use of a capacitor Cr charged by a P-channel MOS transistor MP1 and discharged by an N-channel MOS transistor MN1. Transistors MP1 and MN1 are series connected between terminals 3 and 6 of application of voltage Vbat. The midpoint 23 of this series connection is the output terminal of ramp generator 21, capacitor Cr being connected between terminal 23 and ground 6. The gate of transistor MP1 is connected to the midpoint of a series connection of two P-channel MOS transistors MP2 and MP3, the respective gates of which receive logic signals CTRL1 and CTRL2.

In the embodiment illustrated in FIGS. 3 and 4, it is assumed that a high state on signal CTRL1 indicates an order to program output voltage Vout of the regulator to low level V1 and goes along with a low level on signal CTRL2. Similarly, a high level on control signal CTRL2 goes along with a low level on signal CTRL1 to program the regulator to a high output level V2.

Transistors MP2 and MP3 are connected between terminal 3 and a terminal BP providing a biasing signal. Signal BP is provided by a biasing circuit 24 formed, for example, of a P-channel MOS transistor MP5, mounted in series with a current source 25 between terminals 3 and 6. Transistor MP5 is diode-mounted, its source being connected to terminal 3 and its drain being connected to a first terminal of current source 25, the other terminal of which is grounded. Transistor MP5 also has its drain connected to the drain of transistor MP3. The source of transistor MP3 is connected to the drain of transistor MP2, the source of which is connected to terminal 3. Biasing signal BP is present as soon as the circuit is powered on, that is, as soon as a voltage Vbat is applied between terminals 3 and 6. Current source 25 is, for example, formed of a resistor or of a diode-mounted N-channel MOS transistor.

Referring to transistor MN1, its gate is connected on the one hand to the drain of an N-channel MOS transistor MN2, the source of which is connected to terminal 6 and the gate of which receives signal CTRL1 and, on the other hand, to the drain of an N-channel MOS transistor MN3, the gate of which receives signal CTRL2 and the source of which receives a biasing signal BN. Signal BN is provided by a biasing circuit 26 formed, for example, of an N-channel MOS transistor MN5, series-connected with a current source 27 between terminals 3 and 6. Transistor MN5 is diode-mounted, its source being connected to terminal 6 and its drain being connected to a first terminal of the current source, the other terminal of which is connected to voltage Vbat. Transistor MN5 also has its drain connected to the source of transistor MN3. Current source 27 is, for example, formed of a resistor or of a diode-mounted P-channel MOS transistor. As for circuit 24, circuit 26 is active as soon as the system is powered on.

Assuming a switching of signals CTRL1 and CTRL2 to control an increase of output level Vout of the regulator, signal CTRL1 is switched low while signal CTRL2 is switched high. This conventional switching is abrupt (for example on the order of a few nanoseconds). Transistor MP2 is thus turned on while transistor MP3 is turned off. This results in a blocking of transistor MP1. Referring to transistor MN1, it is turned on by the turning-on of transistor MN3 and the turning-off of transistor MN2.

Accordingly, capacitor Cr, which is initially charged since the last switching of circuit 21 (transistor MP1 was previously on), discharges into transistor MN1. This discharge occurs under a constant current determined by the current of transistor MN4. Signal CTRL1', which was initially high, thus linearly decreases with a ramp having a duration (for example, on the order of a few microseconds) determined by capacitor Cr and the value of current source 27.

Similarly, for a switching of signal CTRL1' in the other direction, signals CTRL1 and CTRL2 are inverted and a similar operation occurs by charging capacitor Cr through transistor MP1 under a current controlled by the value of the constant current of source 25.

It should be noted that, if symmetrical ramps are desired to be obtained on signals CTRL1' and CTRL2', the simplest way is to use capacitors of same value and current sources of same value in ramp generating circuits 21 and 22.

It should also be noted that, upon circuit power-on, capacitor Cr charges or remains discharged according to the respective states of signals CTRL1 and CTRL2.

The structure of circuit 22 for generating ramp CTRL2' can be deduced from the structure of circuit 21 discussed in relation with FIG. 4. The structure is the same and it is enough to invert the respective input positions of signals CTRL1 and CTRL2. Thus, for circuit 22, signal CTRL1 is sent onto the respective gates of transistors MP3 and MN3 while signal CTRL2 is sent onto the respective gates of transistors MP2 and MN2.

Circuits 24 and 26 are, preferably, common to circuits 21 and 22, said circuits receiving identical signals BP and BN.

It should be noted that what has been discussed hereabove in relation with N-channel transistors 12 and 14 also applies in the case of a regulator in which the control transistors have P channels. It is enough to then invert the direction of control ramps CTRL1' and CTRL2'.

An advantage of the present invention is that it suppresses or eliminates undervoltages and/or overvoltages upon switching of the output voltage level of the linear regulator to decrease or increase this level.

Another advantage of the present invention is that it maintains the conventional structure of a linear regulator. Thus, it is enough to act upon the control signals of the MOS transistors of the feedback loop switching circuit to obtain the result of the present invention.

It should be noted that the regulator power consumption in its steady state is not affected by the implementation of the present invention. Indeed, no modification of the static state of the regulator is made necessary by the implementation of the present invention. In particular, biasing circuits 24 and 26 are generally already provided to bias the circuit providing reference voltage Vref.

Of course, the present invention is likely to have various alterations, modifications, and improvements which will readily occur to those skilled in the art. In particular, the respective sizing of the transistors, of the capacitors, and of the current sources depends on the application and is within the abilities of those skilled in the art based on the functional indications given hereabove.

Further, although the present invention has been described hereabove in relation with a linear regulator providing a positive voltage and based on a P-channel power MOS transistor, the present invention can be implemented for a negative voltage regulator, based on the use of an N-channel power transistor. Adapting the circuit for such an application is within the abilities of those skilled in the art.

Moreover, it should be noted that although the present invention has been described hereabove in relation with a regulator adapted to selecting two output voltages, the present invention applies whatever the number of voltages selectable by the regulator. For example, for a regulator having a feedback selection circuit which includes three controllable transistors, implementing the present invention includes controlling these transistors by means of ramps according to the desired voltage variation. For example, consider a circuit with three control transistors in which a fourth resistor is interposed between resistor R3 and the ground, the third control transistor being connected between the junction point of the third and fourth resistors and the non-inverting terminal of amplifier 5. In such a circuit, using the previously-used references, level V1 is obtained when only the first transistor is on, level V2 is obtained when only the second transistor is on, and a level V3 is obtained when only the third transistor is on. To switch from level V1 to level V2, respective decreasing and increasing ramps are applied on the gates of the first and second transistors, the third transistor remaining off. To switch from level V1 to level V3, respective decreasing and increasing ramps are applied on the gates of the first and third transistors, the second transistor remaining off. To switch from level V2 to level V1 , respective increasing and decreasing ramps are applied to the gates of the first and second transistors, the third transistor remaining off. To switch from level V3 to level V2, respective increasing and decreasing ramps are applied to the gates of the second and third transistors, the first transistor remaining off, etc.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A method for controlling a linear regulator including a power MOS transistor controlled by a differential amplifier having a first input terminal receiving a reference voltage and a second input terminal receiving, via a switchable resistor circuit, an output voltage of the linear regulator, said method comprising an act of:

providing for a smooth switching of said switchable resistor circuit by applying at least one voltage ramp on at least one control terminal of a switching element of the switchable resistor circuit.

2. The control method of claim 1, wherein the regulator includes resistors of a dividing bridge switched by means of at least two MOS control transistors, and wherein the method further comprises an act of:

applying on respective gates of the at least two MOS control transistors inverted voltage ramps, directions of which are determined by a switching direction.

3. The method of claim 2, further comprising an act of:

choosing a duration of the inverted voltage ramps to maintain, on the second input terminal of the differential amplifier, a voltage level substantially corresponding to the level of the reference voltage even during switching phases, to avoid unbalancing the differential amplifier.

4. A linear regulator of the type including a power MOS transistor, controlled by a differential amplifier having an input terminal receiving, via a circuit of resistors switchable by means of MOS control transistors, a voltage proportional to the output voltage provided by the regulator, including at least two circuits for generating inverted ramps for controlling the respective gates of said control transistors.

5. The regulator of claim 4, wherein each ramp generation circuit includes, in series between two supply terminals, two transistors of opposite types of channel, the midpoint of their series association providing, via a storage capacitor, said voltage ramp.

6. The regulator of claim 4, wherein the power MOS transistor is of a first channel type, the MOS control transistors being of a second channel type.

7. The regulator of claim 4, wherein the power MOS transistor and the MOS control transistors are of a same channel type.

8. The regulator of claim 5, wherein the power MOS transistor is of a first channel type, the MOS control transistors being of a second channel type.

9. The regulator of claim 5, wherein the power MOS transistor and the MOS control transistors are of a same channel type.

* * * * *

UNITED STATES PATENT AND TRADEMARK OFFICE

CERTIFICATE OF CORRECTION

PATENT NO. : 6,583,607 B1
DATED : June 24, 2003
INVENTOR(S) : Nicolas Marty and Marco Cioci It is certified that error appears in the above-identified patent and that said Letters Patent is hereby corrected as shown below:

Column 4,
Line 9, should read -- resistors of bridge R1-R2-R3 so that the current charging --
Line 44, should read -- and a switching end time t1 when signals CTRL1' and --

Signed and Sealed this

Thirtieth Day of September, 2003

JAMES E. ROGAN
*Director of the United States Patent and Trademark Office*